United States Patent [19]

Suzuki

[11] Patent Number: 4,583,491

[45] Date of Patent: Apr. 22, 1986

[54] TONER CONCENTRATION DETECTING APPARATUS

[75] Inventor: Mitsuo Suzuki, Hitachi, Japan

[73] Assignee: Hitachi, Ltd., Tokyo, Japan

[21] Appl. No.: 635,151

[22] Filed: Jul. 27, 1984

[30] Foreign Application Priority Data

Aug. 12, 1983 [JP] Japan ..... 58-146413

[51] Int. Cl.[4] ..... B05C 11/00

[52] U.S. Cl. ..... 118/689; 118/658

[58] Field of Search ..... 118/689, 657, 658

[56] References Cited

U.S. PATENT DOCUMENTS 4,240,375 12/1980 Terashima ..... 118/689

*Primary Examiner*—Bernard D. Pianalto

*Attorney, Agent, or Firm*—Antonelli, Terry & Wands

[57] ABSTRACT

In a toner concentration detecting apparatus, the inner surfaces of opposing side walls of a detector container, through which a developer in the form of a mixture of a carrier and a toner flows downward, are formed of curved surfaces of large radii of curvature having their centers on the same side, and the sectional area of the passage for the developer is gradually decreased toward the outlet of the detector container.

14 Claims, 8 Drawing Figures

TONER CONCENTRATION DETECTING APPARATUS

This invention relates to an apparatus for detecting the toner concentration of a developer, and more particularly to a detecting apparatus of the kind above described which is suitable for detecting the mixture ratio of a toner and a carrier in a developer used in a developing apparatus employed in the field of electrostatic recording, electrophotography, etc.

One form of electrostatic recording or electrophotographic recording apparatus utilizes a developer including a toner and a carrier (color powder) mixed at a predetermined ratio for turning an electrostatic latent image into a visible image. When such a developer is used for developing an electrostatic latent image, the mixture ratio between the carrier and the toner (the toner concentration) is desirably controlled to lie within a predetermined range. For this purpose, it is necessary to accurately detect the toner concentration of the developer. The carrier is classified into a magnetic carrier, a non-magnetic metal carrier, a non-metallic carrier, etc. Although the developer used in the present invention is not limited to a specific type including a specific type of carrier, the present invention will be described with reference to the use of the developer including the magnetic carrier, by way of example. Further, although there are various toner concentration detecting elements including those responding to changes in the permeability, magnetic flux density and conductivity, the present invention will be described with reference to the use of a toner concentration detecting element detecting the toner concentration on the basis of a change of the inductance of a coil, by way of example.

FIG. 1 shows a developing apparatus provided with a prior art detecting apparatus detecting the developer's toner concentration. FIG. 2 is an enlarged perspective view of the detector part in FIG. 1.

Referring to FIGS. 1 and 2, a pair of side plates 1 are spaced apart by a predetermined distance from each other, and a developer container 2 is interposed between these side plates 1. A magnet roll 3 formed of a permanent magnet is circumferentially magnetized to have a plurality of magnetic poles $S_1$, $N_1$, $S_2$ and $N_2$ arranged in the sequential order and is secured to the side plates 1 in such a relation that the magnetic pole $N_1$ is opposed by a photosensitive drum 9 arranged to rotate in a direction as shown by the arrow A. A rotary sleeve 4 of a non-magnetic material is rotatably mounted around the outer periphery of the magnet roll 3 in concentric relation therewith and is driven by a drive unit (not shown) to rotate in a direction as shown by the arrow B. A developer 5 contained in the developer container 2 includes a mixture of a magnetic carrier and a toner, and agitators 6 and 7 disposed in the developer container 2 agitate the developer 5 to frictionally charge the toner.

By the magnetic force of the stationary magnetic force of the stationary magnet roll 3, the developer 5 is attracted onto the peripheral surface of the non-magnetic rotary sleeve 4, and the attracted developer 5 rotating with the non-magnetic sleeve 4 is restricted in thickness by a doctor blade 8 to form a developer brush 5*a* to be transported toward and onto the surface of the photosensitive drum 9. The transported developer brush 5*a* makes developing engagement at its peripheral surface with the surface of the photosensitive drum 9 having an electrostatic latent image thereon, thereby developing the latent image with the toner. When, thereafter, the magnetic brush 5*a* is brought to the position opposite to a scraper 10, the developer brush 5*a* is scraped off from the surface of the non-magnetic sleeve 4 by the scraper 10, and the greater part 5*b* of the developer 5 falls onto the agitators 6 and 7 for reuse. A portion 5*c* of the scraped developer 5 is guided toward and into a detector container 12 attached to the scraper 10.

The detector container 12 contains therein a detecting element 13 provided by shaping a coil conductor into a flat rectangular form with a resin. The developer 5*c* introduced into the detector container 12 flows downward along the both sides of the detecting element 13 to be discharged to the exterior of the container 12 for reuse. This arrangement is effective in that the toner concentration of the developer 5 can be detected on the basis of the inductance value of the coil of the detecting element 13 since the inductance value of the coil of the detecting element 13 depends upon the permeability of the developer 5. More precisely, the lower the toner concentration of the developer 5, the proportion of the magnetic carrier is larger, and the corresponding increase in the permeability of the developer 5 increases the inductance of the detecting element 13.

In such a toner concentration detecting apparatus, it is required that the developer 5*c* flows always uniformly through the detector container 12. It is also important from the aspect of accuracy of toner concentration detection that the developer 5*c* flows uniformly along the both sides of the detecting element 13. For this purpose, it is necessary to narrow the outlet of the detector container 12 to make the amount of outflow smaller than the amount of inflow, so that the developer 5*c* flows always uniformly through the detector container 12 while overflowing. Since the amount of inflow of the developer 5*c* is determined by the amount of the developer 5 transported by the non-magnetic sleeve 4, the sectional area of the outlet of the detector container 12 cannot be excessively increased. Further, depending on the fluidity of the developer 5 used for developing, clogging occurs at the outlet and other portions of the detector container 12, resulting in impossibility of insurance of stable flow of the developer 5. The fluidity of the developer 5 varies greatly depending on the factors including the particle shape of the carrier, the particle size distribution of the carrier and the toner concentration. Thus, the prior art detecting apparatus has been defective in that the kind of the developer 5 satisfactorily usable for developing is greatly limited, and the developer 5 cannot always flow stably through the detector container 12.

In an attempt to obviate such a defect, an improved apparatus as shown in FIG. 3 has been proposed in which an auxiliary magnet roll 16 for developer discharging purpose is provided so that a constant amount of the developer 5*c* can be forcedly discharged from the outlet of the detector container 12. However, the proposed detecting apparatus has also been effective in that it is difficult to ensure a uniform flow of the developer 5*c* along the both sides of the detecting element 13, and, also, the apparatus becomes complex and expensive.

As examples of publications disclosing the prior art apparatus described above, U.S. Pat. No. 3,999,687 and U.S. Pat. No. 4,131,081 can be cited.

It is therefore a primary object of the present invention to provide an improved toner concentration detecting apparatus which ensures a stable flow of the developer in the detector container so that the toner concentration can be accurately detected.

In accordance with the present invention which attains the above object, there is provided a toner concentration detecting apparatus for use in a developing apparatus comprising a developer container containing a developer including a carrier and a toner, means for transporting the developer contained in the developer container toward and onto the surface of a recording medium having an electrostatic latent image thereon, means for guiding a portion of the developer toward and into a detector container, and means for measuring the mixture ratio of the carrier and the toner in the developer introduced into the detector container, wherein the inner surfaces of opposing side walls of the detector container are so configured that they are formed of curved surfaces of large radii of curvature having their centers on the same side of the detector container and the passage defined between the side wall surfaces is gradually narrowed toward the outlet of the detector container, and a toner concentration detecting element is disposed along substantially the flowing direction of the developer flowing downward in the detector container, whereby to minimize the flow resistance of the detector container and improve the fluidity of the developer.

BRIEF DESCRIPTION OF THE DRAWINGS

The present invention will be apparent from the following detailed description taken in conjunction with the accompanying drawings, in which.

DETAILED DESCRIPTION OF THE DRAWINGS

The present invention will now be described in detail with reference to FIGS. 4 to 8. In an effort to obviate the prior art defects pointed out above, the inventors made various researches and studies on the prior art detector containers and then made trial manufacture of many models and experiments on the models. The results of experiments have clarified that, due to the abrupt reduction of the sectional area at and in the vicinity of the outlet of the prior art detector containers and due to the presence of corners in that portion, the large resistance against flow of the developer results in clogging at the corners and outlet portion, and vibrations result also in clogging on the both sides of the detecting element. It is well known that the resistance against flow of a fluid in a conduit increases generally greatly when the conduit includes corners or when the direction of fluid flow changes sharply. Although the developer itself is a solid, it flows in the form of a pulverulent fluid, and the above concept applies also to the developer in this respect.

Figure 1:
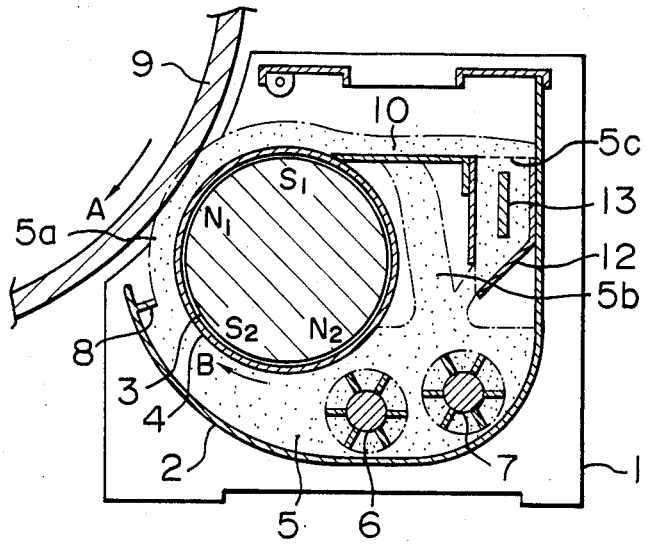
FIG. 1 PRIOR ART
FIG. 1 is a schematic sectional view illustrating the structure of a prior art developing apparatus.
Figure 2:
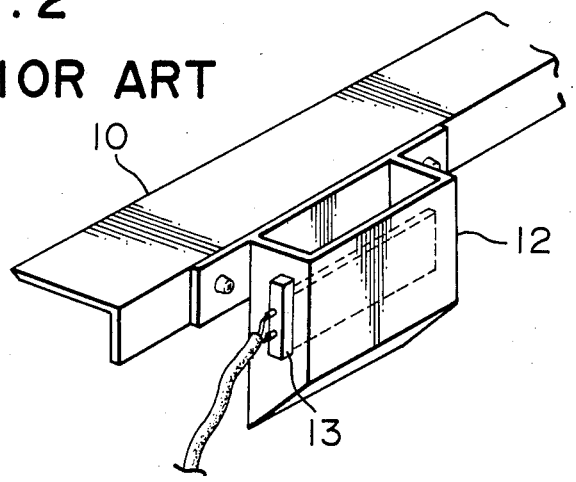
FIG. 2 PRIOR ART
FIG. 2 is a perspective view of the toner concentration detecting part in FIG. 1.
Figure 3:
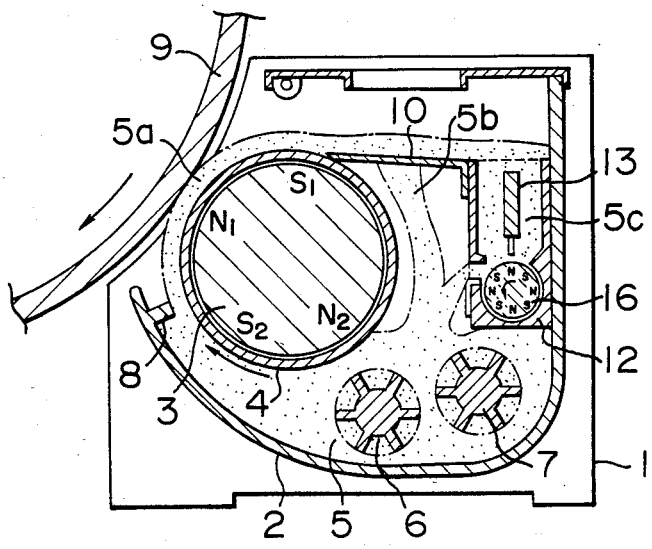
FIG. 3 PRIOR ART
FIG. 3 is a schematic sectional view illustrating the structure of another prior art developing apparatus.
Figure 4:
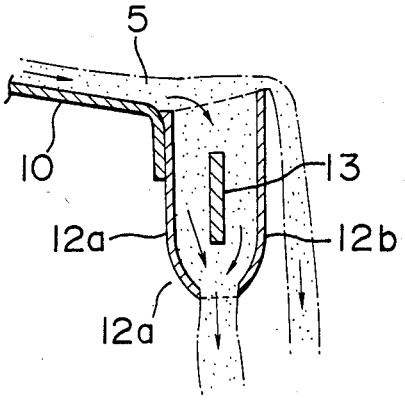
FIG. 4 is a schematic sectional view of an improved detector container.

From that standpoint, the inventors have made researches and studies on an improved form of the detector container 12 as shown in FIG. 4. In the improved detector container 12 shown in FIG. 4, the corners are eliminated, and side walls 12*a* and 12*b* restricting the amount of outflow of the developer are formed by curved surfaces of large radii of curvature gradually narrowing the passage, thereby reducing the resistance against flow of the developer. The results of an experiment conducted on the improved detector container 12 shown in FIG. 4 have proved that the performance of the improved detector container 12 is not conspicuously improved over that of the prior art detector container 12 shown in FIG. 1. The reason why the fluidity of the developer is not improved regardless of the reduced resistance of the detector container itself against flow owing to the improved configuration of the passage is considered to be attributable to the fact that the flowing direction of the developer portions flowing downward along the both sides of the detecting element 13 is diverted inward by the curved inner surfaces of the side walls 12*a* and 12*b* of the detector container 12, and finally the developer portions flowing downward past the lower end of the detecting element 13 collide with each other. Due to the collision of the developer portions in that zone, the force causing downward flow of the developer 5 toward the outlet of the detector container 12 is reduced to give rise to clogging in that zone, and, consequently, the fluidity of the developer 5 is not improved.

Embodiments of the present invention based on the results of researches and studies above described will now be described with reference to FIGS. 5, 6 and FIGS. 7, 8.

Figure 5:
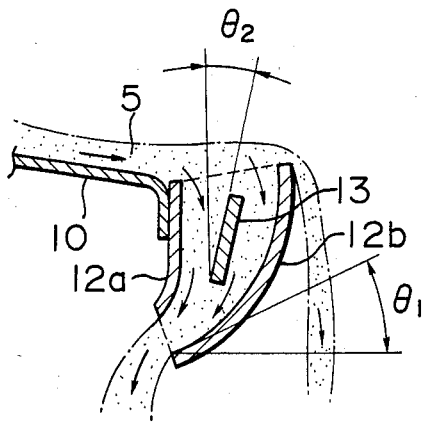
FIGS. 5 and 6 are schematic sectional views of two forms respectively of the detector container according to the present invention.
Figure 6:
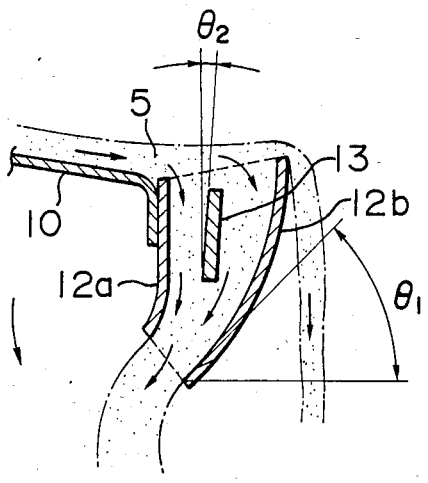

In each of the detector containers 12 shown in FIGS. 5 and 6, curved surfaces of large radii of curvature having their centers on the same side of the detector container 12 and upper planar surfaces contiguous to those curved surfaces constitute the inner surfaces of the two side walls 12*a* and 12*b* when the section is taken at right angles with respect to the flat detecting element 13. It will be seen that the passage portions of the developer 5 on the both sides of the detecting element 13 and the joined passage downstream of the detecting element 13 are gradually narrowed toward the outlet of the detector container 12 so that the developer 5 flows downward in substantially the same direction in the detector container 12. The flat detecting element 13 is disposed at the center of the passage in a relation inclined at an angle $\theta_2$ with respect to the perpendicular so that the resistance against flow can be minimized. By so configuring the passage in the detector container 12, the resistance of the inner wall surfaces of the detector container 12 against flow can be minimized and, also, the increase in the flow resistance due to the gradually reduced sectional area of the passage can be minimized. Further, the reduction of the fluid driving force in the flowing direction due to collision of the developer portions flowing downward along the both sides of the detecting element 13 can also be suppressed to a minimum. Consequently, it has been experimentally confirmed that the developer shows a very satisfactorily fluidity. It has also been confirmed that the larger the inclination $\theta_1$ of the inner curved surface of the side wall 12*b* with respect to the horizontal, the fluidity is better, and the upper limit of the inclination $\theta_1$ is about 30°.

Figure 7:
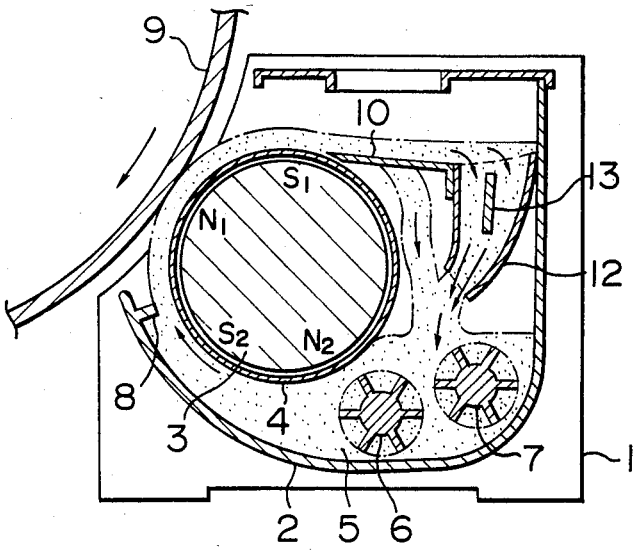
FIGS. 7 and 8 are schematic sectional views showing the structure of developing apparatus incorporating two embodiments respectively of the toner concentration detecting apparatus of the present invention.

FIG. 7 shows one form of the developing apparatus incorporating an embodiment of the toner concentration detecting apparatus of the present invention. Referring to FIG. 7, by the magnetic force of the stationary magnet roll 3, the developer 5 is attracted toward and onto the peripheral surface of the non-magnetic rotary sleeve 4, and the attracted developer 5 rotating with the non-magnetic sleeve 4 is restricted in thickness by the doctor blade 8 to form a developer brush 5*a* to be transported toward and onto the surface of the photosensitive drum 9. The transported developer brush 5*a* makes developing engagement at its peripheral surface with the surface of the photosensitive drum 9 having an electrostatic latent image thereon, thereby developing the latent image with the toner. When, thereafter, the magnetic brush 5*a* is brought to the position opposite to the scraper 10, the developer brush 5*a* is scraped off from the surface of the non-magnetic sleeve 4 by the scraper 10, and the greater part 5*b* of the developer 5 falls onto the agitators 6 and 7 for reuse. A portion 5*c* of the scraped developer 5 is guided toward and into the detector container 12 which is constructed as described with reference to FIGS. 5 or 6. The detector container 12 contains therein the detecting element 13 provided by shaping a coil conductor into a flat rectangular form with a resin. The developer 5*c* introduced into the detector container 12 flows downward along the both sides of the detecting element 13 to be discharged to the exterior of the container 12 for reuse. The toner concentration of the developer 5 can be detected on the basis of the inductance value of the coil of the detecting element 13 since the inductance value of the coil of the detecting element 13 depends upon the permeability of the developer 5.

Figure 8:
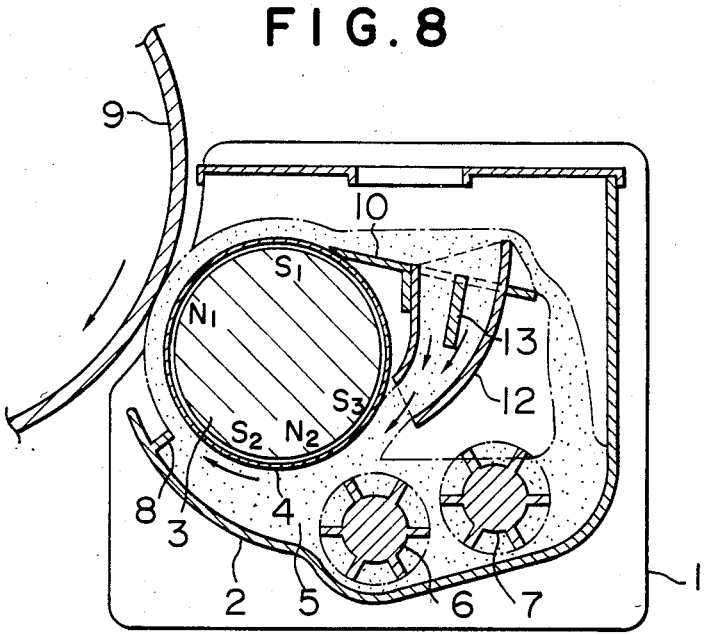

FIG. 8 shows another form of the developing apparatus incorporating another embodiment of the toner concentration detecting apparatus of the present invention. Referring to FIG. 8, the detector container 12 is disposed in such a relation that the outlet thereof is situated adjacent to the non-magnetic rotary sleeve 4 disposed around the magnet roll 3 in concentric relation therewith. The magnet roll 3 is magnetized to have the magnetic poles $S_1$, $S_2$ and $N_2$ for developer transporting purpose in addition to the main magnetic pole $N_1$ for developing purpose. The magnet roll 3 is further provided, at a portion corresponding to the neighborhood of the outlet of the detector container 12, with an auxiliary magnetic pole $S_3$ of the same polarity as the magnetic pole $S_1$ disposed adjacent to the inlet of the detector container 12. By the action of the magnetic flux produced by the auxiliary magnetic pole $S_3$, the portion of the developer 5 flowing downward in the neighborhood of the outlet of the detector container 12 is forcedly drawn out and discharged. The embodiment shown in FIG. 8 is therefore advantageous over that shown in FIG. 7 in that the developer 5 is caused to flow more positively.

Although the detecting element 13 employed in the aforementioned embodiments of the present invention is of the permeability sensitive type, it is apparent that it may be replaced by, for example, the type sensitive to the relative quantity of magnetic flux, the type sensitive to the relative flux density or the type sensitive to the conductivity (the electrical resistance) of the developer. Also, the magnetic carrier in the developer may be replaced by a non-magnetic carrier. In such a case, the detecting element 13 is preferably of the type sensitive to the conductivity of the developer.

I claim:

1. A toner concentration detecting apparatus for use in a developing apparatus comprising a developer container containing a developer including a carrier and a toner, means for transporting said developer contained in said developer container toward and onto the surface of a recording medium having an electrostatic latent image thereon, means for guiding a portion of said developer toward and into a detector container, and means for measuring the mixture ratio of the carrier and the toner in said developer introduced into said detector container, wherein the inner surfaces of two opposing side walls of said detector container are so configured that they are formed of curved surfaces of large radii of curvature having their centers on the same side of said detector container and the passage defined between said side wall surfaces is continuously gradually narrowed toward the outlet of said detector container, and a toner concentration detecting element is disposed along substantially the flowing direction of said developer flowing downward in said detector container, the passage defined between the side wall surfaces being continuously gradually narrowed along the detecting element and downstream of the detecting element toward said outlet, said passage being sufficiently continuously gradually narrowed toward the outlet of said detector container such that the developer flows downward in substantially the same direction in said detector container.

2. A toner concentration detecting apparatus as claimed in claim 1, wherein said detector container is disposed in the vicinity of said developer transporting means including a magnet, and said magnet includes an auxiliary magnetic pole disposed adjacent to the outlet of said detector container and having the same polarity as that of another magnetic pole disposed adjacent to the inlet of said detector container, said auxiliary magnetic pole acting to forcedly discharge said developer from said detector container.

3. A toner concentration detecting apparatus as claimed in claim 2, wherein said magnet constitutes part of said means transporting said developer contained in said developer container toward and onto the electrostatic latent-image bearing surface of said recording medium.

4. A toner concentration detecting apparatus as claimed in claim 1, wherein the detecting element is positioned in said passage to provide passage portions at each side thereof, and wherein said passage portions, at each side of the detecting element, continuously gradually narrow.

5. A toner concentration detecting apparatus for use in a developing apparatus comprising a developer container containing a developer including a carrier and a toner, means including a non-magnetic rotary sleeve and a magnet disposed in said sleeve for transporting said developer contained in said developer container toward and onto the surface of a recording medium having an electrostatic latent image thereon, means for guiding a portion of said developer toward and into a detector container, and means for measuring the mixture ratio of the carrier and the toner in said developer introduced into said detector container, wherein the inner surfaces of two opposing side walls of said detector container are so configured that they are formed of curved surfaces of large radii of curvature having their centers on the same side of said detector container and the passage defined between said side wall surfaces is continuously gradually narrowed toward the outlet of said detector container, said outlet of said detector container being disposed adjacent and opposite to a magnetic pole of said magnet, and wherein a toner concentration detecting element is disposed along substantially the flowing direction of said developer flowing downward in said detector container, the passage defined between the side wall surfaces being continuously gradually narrowed along the detecting element and downstream of the detecting element toward said outlet, said passage being sufficiently continuously gradually narrowed toward the outlet of said detector container such that the developer flows downward in substantially the same direction in said detector container.

6. A toner concentration detecting apparatus as claimed in claim 5, wherein the detecting element is positioned in said passage to provide passage portions at each side thereof, and wherein said passage portions, at each side of the detecting element, continuously gradually narrow.

7. A toner concentration detecting apparatus as claimed in claim 5, wherein the detecting element is a flat detecting element, positioned at an angle to the perpendicular to minimize resistance against flow.

8. A toner concentration detecting apparatus as claimed in claim 5, wherein the inner surface of the side wall further from the centers of the large radii of curvature, at the outlet of the detector container, forms an angle of inclination with the horizontal that is up to 30°.

9. A toner concentration detecting apparatus as claimed in claim 5, wherein said passage is provided to continuously gradually narrow along the detecting element and downstream of the detecting element toward said outlet by providing said inner surfaces to have different radii of curvature.

10. A toner concentration detecting apparatus as claimed in claim 5, wherein said passage continuously gradually narrows from the inlet of the detector container to the outlet of the detector container.

11. A toner concentration detecting apparatus as claimed in claim 1, wherein the detecting element is a flat detecting element, positioned at an angle to the perpendicular to minimize resistance against flow.

12. A toner concentration detecting apparatus as claimed in claim 1, wherein said passage is provided to continuously gradually narrow along the detecting element and downstream of the detecting element toward said outlet by providing said inner surfaces to have different radii of curvature.

13. A toner concentration detecting apparatus as claimed in claim 1, wherein the inner surface of the side wall further from the centers of the large radii of curvature, at the outlet of the detector container, forms an angle of inclination with the horizontal that is up to 30°.

14. A toner concentration detecting apparatus as claimed in claim 1, wherein said passage continuously gradually narrows from the inlet of the detector container to the outlet of the detector container.

* * * * *